United States Patent [19]

Klee

[11] Patent Number: 4,580,413

[45] Date of Patent: Apr. 8, 1986

[54] PRESSURIZED FLUID LIFT SYSTEM FOR A CRYOGENIC FREEZER

[75] Inventor: David J. Klee, Emmaus, Pa.

[73] Assignee: Air Products and Chemicals, Inc., Allentown, Pa.

[21] Appl. No.: 741,986

[22] Filed: Jun. 6, 1985

[51] Int. Cl.[4] ..... F25D 25/04

[52] U.S. Cl. ..... 62/380; 49/116; 49/118; 62/303

[58] Field of Search ..... 62/374, 380, 298, 303, 62/449; 49/116, 118

[56] References Cited

U.S. PATENT DOCUMENTS

| | | | |
|---|---|---|---|
| 1,822,077 | 9/1931 | Birdseye | 62/341 |
| 3,226,947 | 1/1966 | Wakatsuki et al. | 62/303 |
| 3,580,000 | 5/1971 | Wagner | 62/303 |
| 3,583,171 | 6/1971 | Flynn et al. | 62/303 |
| 3,757,533 | 9/1973 | Kent | 62/303 |
| 3,813,895 | 6/1974 | Klee et al. | 62/303 |
| 3,892,104 | 7/1975 | Klee et al. | 62/380 |

*Primary Examiner*—Ronald C. Capossela
*Attorney, Agent, or Firm*—Geoffrey L. Chase; E. Eugene Innis; James C. Simmons

[57] ABSTRACT

A cooling and or freezing tunnel is described having a toggle linkage and a pressurized fluid drive to open and close a plurality of openable sections of the tunnel for access and cleaning of the interior. The toggle linkages provide more accurate and reliable movement than the prior art means for opening such tunnels.

16 Claims, 5 Drawing Figures

PRESSURIZED FLUID LIFT SYSTEM FOR A CRYOGENIC FREEZER

TECHNICAL FIELD

The present invention is directed to the field of cryogenic freezers. More specifically, the present invention is directed to means for accurately opening and closing a cryogenic freezer for servicing and cleaning.

BACKGROUND OF THE PRIOR ART

Apparatus for cooling and freezing of articles, such as foodstuffs, is well known in the prior art. Relevant prior art apparatus generally comprise elongated freezing tunnels through which articles to be cooled and frozen are passed, generally on a moving belt or other conveyor means. Long, narrow cooling and freezing tunnels are necessary to minimize crycgen requirements, yet allow for long contact times for articles or foodstuffs to be cooled or frozen. Maintenance and cleaning present a problem for such elongated tunnels, particularly with regard to interior access.

The opening of such cooling and freezing tunnels to render them readily accessible is necessary, particularly wherein foodstuffs are passed through the tunnel for cooling and freezing. In the use of such tunnels, crumbs and particles of food are frequently broken off of the food articles being moved through the tunnel and remain in the interstices of the conveyor belt or fall through the belt onto the bottom of the tunnel. Such particles, if permitted to remain in the apparatus, will become spoiled and may contaminate fresh food passing there through. Consequently, it is imperative that means be provided to facilitate cleaning of such apparatus to meet USDA standards, as well as to facilitate inspection thereof by USDA officials.

The construction of prior art apparatus, however, inherently hindered the attainment of these objectives. This was caused primarily by the fact that the tunnels had to have gas tight seals along their lengths, which rendered disassembly thereof difficult. Moreover, the length of the tunnels, often over 50 ft. long, frustrated effective hosing down from end to end.

For instance, in U.S. Pat. No. 3,813,895 a freezing tunnel is described wherein a continuous conveyor travels longitudinally through an insulated freezing tunnel refrigerated with a cryogenic fluid, such as liquid nitrogen. The freezing tunnel is designed so that a bottom and a hinged cover can be opened downwardly and pivotably upward, respectively, to gain access to the interior of the tunnel, the conveyor, and the stationary assemblies, specifically for cleaning and inspection. The actuation of the movement of the covers and bottoms of such a tunnel is performed by a series of rotary geared screw jacks driven by a drive shaft connected to an electric motor housed under the tunnel and connected to a drive shaft by geared transmission means. Despite this prior art means for opening a cooling and freezing tunnel, durable and accurate means for opening such tunnels for cleaning and inspecting repeatedly during the course of use, particularly long term use, remains to be found.

Other prior art freezing tunnels are known wherein portions of the tunnel may be opened for access. U.S. Pat. No. 3,892,104 discloses such a tunnel and details the manner for variably controlling the flow of cooling gas through the tunnel. As shown in FIG. 2 of that patent, the cooling tunnel is opened by a series of rotary geared screw jacks 24 which raise and lower the bottom of the tunnel.

Other patents of general interest to the cooling and freezing tunnel art include U.S. Pat. Nos. 1,822,077, 3,580,000, 3,583,171 and 3,757,533.

All of the prior art suffers from either a failure to provide adequate means for gaining access to the interior of an elongated cooling or freezing tunnel, or the means utilized for opening and closing an accessible freezing tunnel are not durable under the moisture and caustic conditions inherent in a tunnel that is periodically washed down and cleansed. Such prior art also is susceptible of inaccurate movement of the openable sections of the tunnel when individual rotary geared screw jacks are replaced after service is performed on the tunnel. In addition, prior art actuation means do not provide the variable force desired to open an openable freezing tunnel, wherein the initial opening force is required to exceed the normal force for movement or travel of the openable sections due to the problem of frozen and sticking components in the openable sections. The present invention overcomes these drawbacks as will be readily understood from the description below.

BRIEF SUMMARY OF THE INVENTION

The present invention comprises an apparatus for continuous cooling and/or freezing of articles including an elongated tunnel defined by a plurality of alternate openable and stationary sections, a conveyor means in said tunnel for moving articles longitudinally there through, a means for applying cooling fluid to articles moving through said tunnel, a means for inducing movement of said cooling fluid through said tunnel in generally counterflow relation to the direction of movement of articles moved through said tunnel, a means carried solely by said plurality of stationary sections for supporting said conveyor means within said tunnel, means for opening said openable sections whereby complete access may be had to all of said sections of said tunnel without moving said conveyor means relative to said stationary sections and actuation means including an assembly of toggle linkages connected through push rods to a pressurized fluid drive means for moving the openable sections of said apparatus to an open or closed position respective to said stationary sections.

Preferably the tunnel is supported along its length on a stationary tunnel support frame.

The openable sections of the elongated tunnel comprise top, depending sidewall portions defining hinged covers adapted to open upwardly and bottoms supported on a lift frame adapted to open downwardly.

Preferably, the toggle linkages are pivotably connected to the tunnel support frame and the lift frame to raise the bottom of the openable section to the closed position or lower the bottom to an open position upon actuation by the pressurized fluid drive through the push rods.

Preferably, the hinged covers are opened and closed simultaneously with the bottoms by a cable linkage between the covers and bottoms.

The lift frame extends under and supports a plurality of said bottoms of the openable sections and is actuated by said toggle linkages whereby a plurality of said bottoms can be moved in unison by a set of toggle linkages.

Preferably the lift frame has an end guide at either longitudinal end thereof which cooperates slidingly with a bumper on the stationary tunnel support frame to retain the lift frame in longitudinal position when the actuation means is actuated.

Preferably each toggle linkage comprises a first link pivotably connected at its one end to the lift frame and pivotably connected at its other end to the push rod and a second link pivotably connected at its one end to the stationary tunnel support frame and pivotably connected at its other end to said push rod.

Optimally, each link of the toggle linkage is positioned at an angle of approximately 73 degrees to the horizontal when the tunnel is in its closed position.

Optimally, the lift frame of the tunnel is arranged to move approximately 8½" along its vertical axis between the open and closed positions of the openable sections of the tunnel.

DETAILED DESCRIPTION OF THE INVENTION

Figure 1:
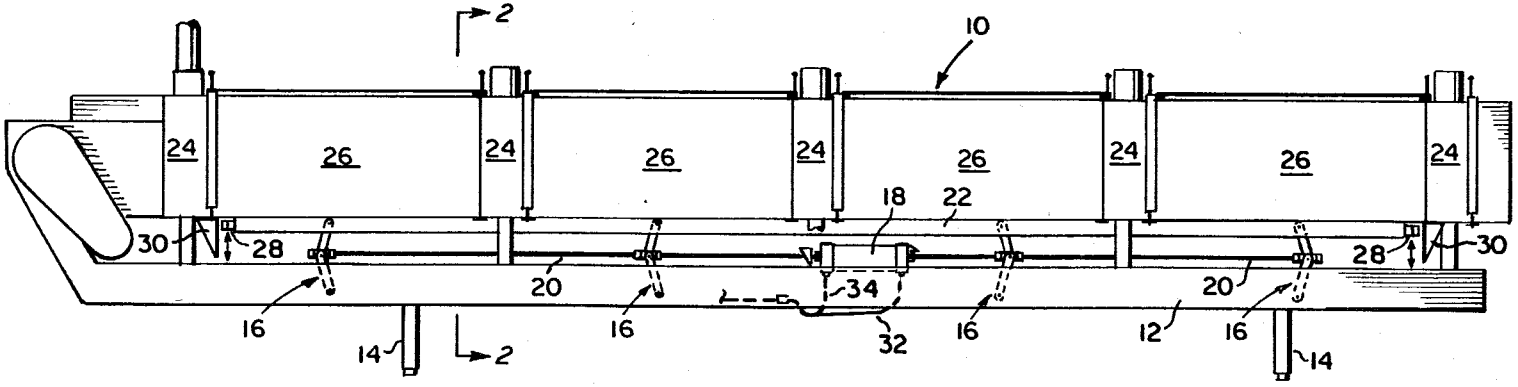
FIG. 1 is a side view of the elongated cooling and freezing tunnel of the present invention showing the toggle linkage which movably supports the lift frame from the stationary tunnel support frame.

The present invention provides a novel actuation means for facilitating the rapid and effective opening and accessing of a cooling and freezing tunnel. The novel opening actuation means also facilitates periodic inspection of the tunnel.

The novel actuation means allows the openable sections of the tunnel, including back to back hinged top covers which pivotably open and a bottom underlying the covers that may be moved downwardly to expose the interior of all sections of the tunnel, to be opened and closed in a rapid, accurate and reliable manner.

The prior art typically utilized, electrically operated rotary geared screw jacks positioned at various locations between the support frame and the lift frame to move the lift frame. However, each jack had to be separately calibrated and matched with the other jacks. Such jacks were also capable of only a single level of exerted force. The present invention utilizes actuation means including toggle linkages which inherently have precise length and movement to perform the actuation to move the openable sections of the tunnel to an open or closed condition, respectively, without the need for electrically driven actuation. These toggle linkages operate with a pressurized fluid drive means, such as pneumatically or hydraulically driven piston and cylinder means. In addition, the toggle linkages are able to exert variable force, wherein the initial force of the drive is increased by a factor of approximately 1.7 by the arrangement of the linkage at an angle of approximately 73 degrees to the horizontal axis. This allows for forceable "breaking" of the seal of the openable sections in the tunnel, which is beneficial when frosted or frozen sealing surfaces of the tunnel sections exist.

By operating the actuation means with a pressurized fluid drive, the toggle linkage assembly connected by a series of pushrods to the drive, is effectively less susceptible to water and cleaning agent infiltration and degradation than prior art actuation means such as rotary screw jacks. By relying on the designed travel of the pressurized fluid pistons in a pressurized fluid cylinder of the drive to prescribe the length of travel of the push rods and the degree of movement of the toggle linkages, a finite movement or travel of the lift frame relative to the support frame along a vertical axis between the open and closed positions of the openable sections of the tunnel is reliably provided and reproduced, in contrast to the requirement for electrical limit switches when using rotary geared screw jacks, as in the prior art.

The actuation means of the present invention achieves precise positioning of the lift frame in both the open and closed tunnel positions, because it employs a precise toggle linkage. Each pressurized fluid drive comprises a pair of pistons in cylinders which travel their full stroke of approximately 9⅜" providing an exact position for the lift frame in both the open and closed tunnel position. The actuation means of the present invention is ideally suited to breaking open the openable sections of the tunnel when the sections are frozen in their closed position. In the closed position, each toggle link is positioned at 73.5 degrees to the horizontal axis. At this angle the drive push force is multiplied by 1.69 times. However, as the toggle linkage folds when the lift frame lowers to the open position, the vertical force on the lift frame gradually reduces to only 20.9% of the drive push force, as the linkage attains the full open position. The lower vertical force matches the reduction in force required as the hinged covers of the openable sections of the tunnel tilt upward to the open position.

The present invention will now be described in greater detail with reference to a preferred embodiment as illustrated in the drawings.

With reference to FIG. 1, an elongated cooling and/or freezing tunnel 10 is shown wherein alternate openable sections 26 and stationary sections 24 are assembled to create the elongated tunnel. The tunnel is mounted on a stationary tunnel support frame 12 which in turn is supported on various legs 14 to a permanent floor. The stationary sections 24 of the tunnel are supported directly and independently on the stationary tunnel support frame 12. The openable sections 26 of the tunnel are supported in part on a lift frame 22 such that the lift frame 22 supports a plurality of the bottoms 40 of the openable sections 26 while the sections 24 support the covers 27. In turn, the lift frame is supported on a plurality of toggle linkages 16 which are pivotably collapsed and opened by actuation of a push rod 20 driven by a pressurized fluid drive means 18 comprising a pneumatic or hydraulic piston in a cylinder. The gas or liquid supply to the pressurized fluid drive is provided through lines 32 and 34, which respectively activate different ends of the cylinder of the pressurized fluid drive. Any reasonable source of controlled pressurized air or other fluids may be utilized to supply the drive 18. Due to the pivotable nature of the toggle linkage support of the lift frame 22, end guides 28 are affixed to the lift frame 22 to slideably cooperate with a bumper 30 affixed to the terminal stationary sections 24 of the stationary tunnel support frame 12 of the tunnel 10. The end guides 28 and bumpers 30 prevent longitudinal movement of the lift frame assembly during movement of the assembly upward or downward to the open or closed positions of the tunnel.

Figures 2, 3, 4:
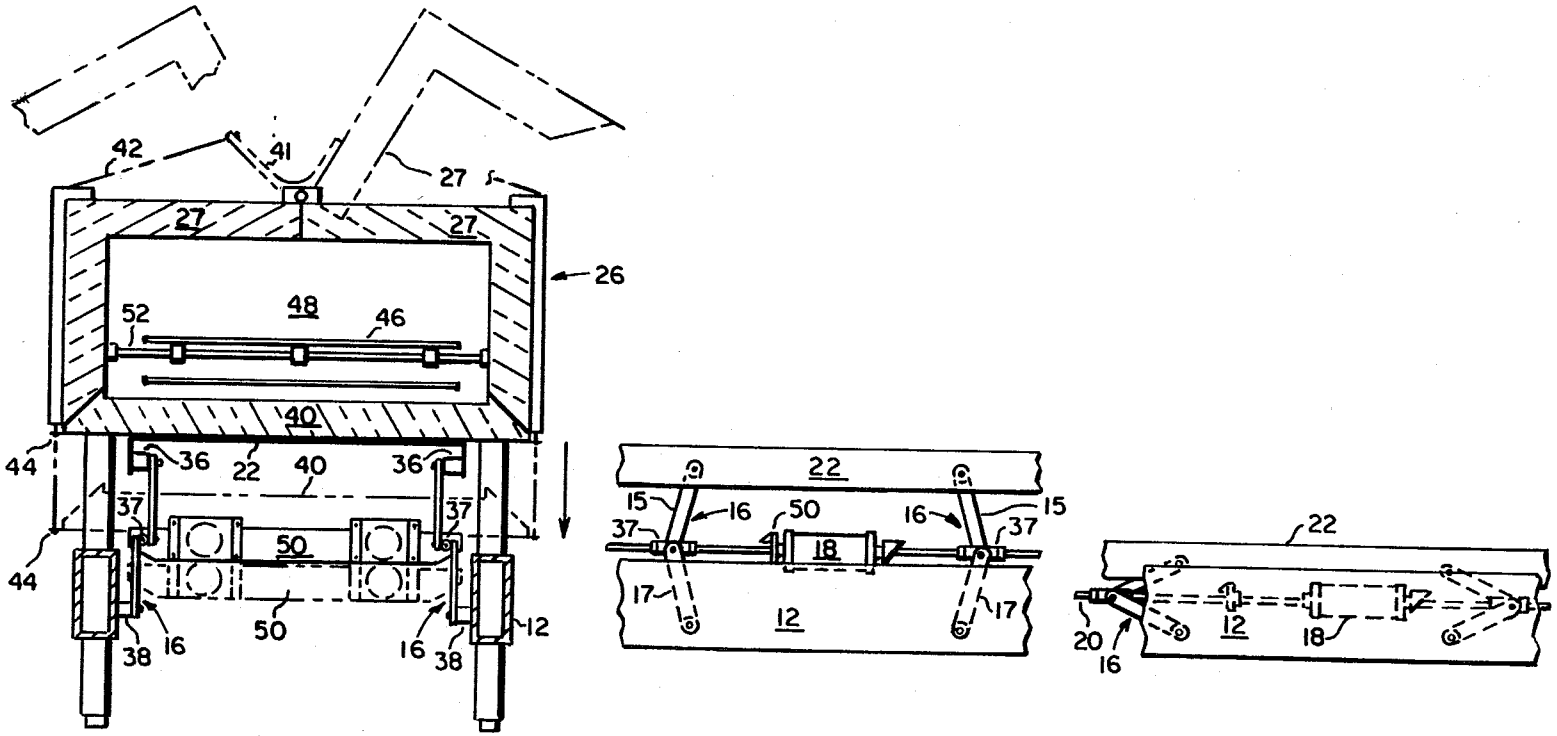
FIG. 2 is an enlarged vertical section view taken along line 2—2 of FIG. 1 and illustrates, in phantom, a movable section in the open position, the hinged top covers being pivoted upwardly and the bottom being lowered substantially beneath the lower reach of the endless conveyor belt of the tunnel.
FIG. 3 is a fragmentary view of the toggle linkage, the lift frame and the stationary tunnel support frame in the closed position of the tunnel.
FIG. 4 is a similar view as FIG. 3 showing the toggle linkage in its alternate extreme position after actuation to a lowered position of the lift frame in the open position of the tunnel.

With reference to FIG. 2 which constitutes a view taken along the lines 2—2 of the tunnel of FIG. 1, the structure of the openable section of the tunnel is illustrated. The openable section 26 comprises top, depending sidewall portions defining hinged covers 27 which cooperatingly close and mate with a bottom 40 supported on a lift frame 22. The hinged cover 27 and the bottom 40 constitute insulated panels comprising metal exteriors with interiors filled with an insulating material and gasketed at their edges with a sealing strip, such as a hollow tube constructed of silicone rubber or other resilient rubber-like gasket material. The interior 48 of the tunnel 10 contains a continuous endless conveyor belt 46 which traverses the longitudinal axis of the tunnel and is supported by various longitudinal support bars 52 affixed to each of the stationary sections of the tunnel. The tunnel is supported on the stationary tunnel support frame 12 through an assembly of the pivotably connected toggle linkages 16, two parallel sets of push rods and drives, the lift frame 22 and the stationary sections 24. Each linkage 16 rotates about a pivot point 36 with the lift frame, a pivot point 38 with the support frame and a pivot point 37 with the push rod 20. A cable 42, typically comprised of a metal multistrand cable, is connected between a finger 44 of the bottom 40 of the movable section 26 of the tunnel 10 and an arm 41 of each hinged cover 27. As the drive, supported on support plate 50, moves the toggle linkages to pull the bottom 40 down along its approximate 8½" travel to open the tunnel for accessibility, the finger 44 pulls the cable 42 and in turn pulls the arm 41 to pivotably elevate and open the hinged cover 27 simultaneous with the descending bottom 40.

The relative movement of the openable section of the tunnel as supported on the lift frame and stationary section 24 is best illustrated by comparison of FIG. 3 and FIG. 4. In FIG. 3, a section of the actuation means comprising the drive 18, push rod 20 and the toggle linkages 16 are pivotably connected to the lift frame 22 and the stationary tunnel support frame 12, as illustrated. The toggle linkages 16 are in their angled position wherein the angle is 73.5 degrees from the horizontal axis, the lift frame 22 is in its most upward position and the tunnel is closed for appropriate cooling and/or freezing function (not shown). This angled position of the toggle linkages 16 provides the increased force above the initial force provided by the drive 18 such that the force is magnified approximately 1.69 times the drive force. In FIG. 4, the same assembly is shown in the open position wherein the toggle linkages 16 are collapsed and the push rods are extended from their position illustrated in FIG. 3. Additionally, the lift frame 22 has traveled its preferred approximate 8½" in a downward and opening position, such as to make accessible the interior of the tunnel by the dropping of the bottom 40 and the pivotal opening of the hinged covers 27 (the latter not shown). At this opened position, the toggle linkages exert only a force approximately 20.9% of the driving force of the drive 18. As can be seen in FIG. 4, the entire actuation means, including toggle linkages 16, push rods 20 and drive 18, travel in a downward direction during the opening sequence wherein the push rods are extended outward in an axial direction.

Movement of the lift frame 22 in the up and down travel or movement to open and close the tunnel is precise and accurate. Such precise movement is dependent only upon the travel of the piston in the cylinder of the drive 18 and the length of the push rods 20 and individual links 15 and 17 shown in FIG. 3 of the toggle linkages 16. As compared to the rotary geared screw jacks of the prior art, the toggle linkages 16 of the present invention do not require calibration because the extent of their movement is dependent upon their precise length as initially fabricated. When a linkage is assembled to the overall actuation means, its travel is effectively predesigned and set. Even a replacement linkage does not require expert installation or calibration, but is fully adjusted for travel and movement by its fabricated and machined length which can be standardized and predetermined in a factory setting far superior to the setting of calibration at a field installation. Additionally, the use of the simple toggle linkage, push rod and pressurized fluid drive is far superior in the moist, potentially corrosive, environment of a cooling and freezing tunnel wherein periodic washing and water contact are necessary. Electrical jack drives and limit switches necessary in the prior art were subject to periodic failures due to water or cleaning agent infiltration. The present invention is not susceptible to such maintenance problems.

Figure 5:
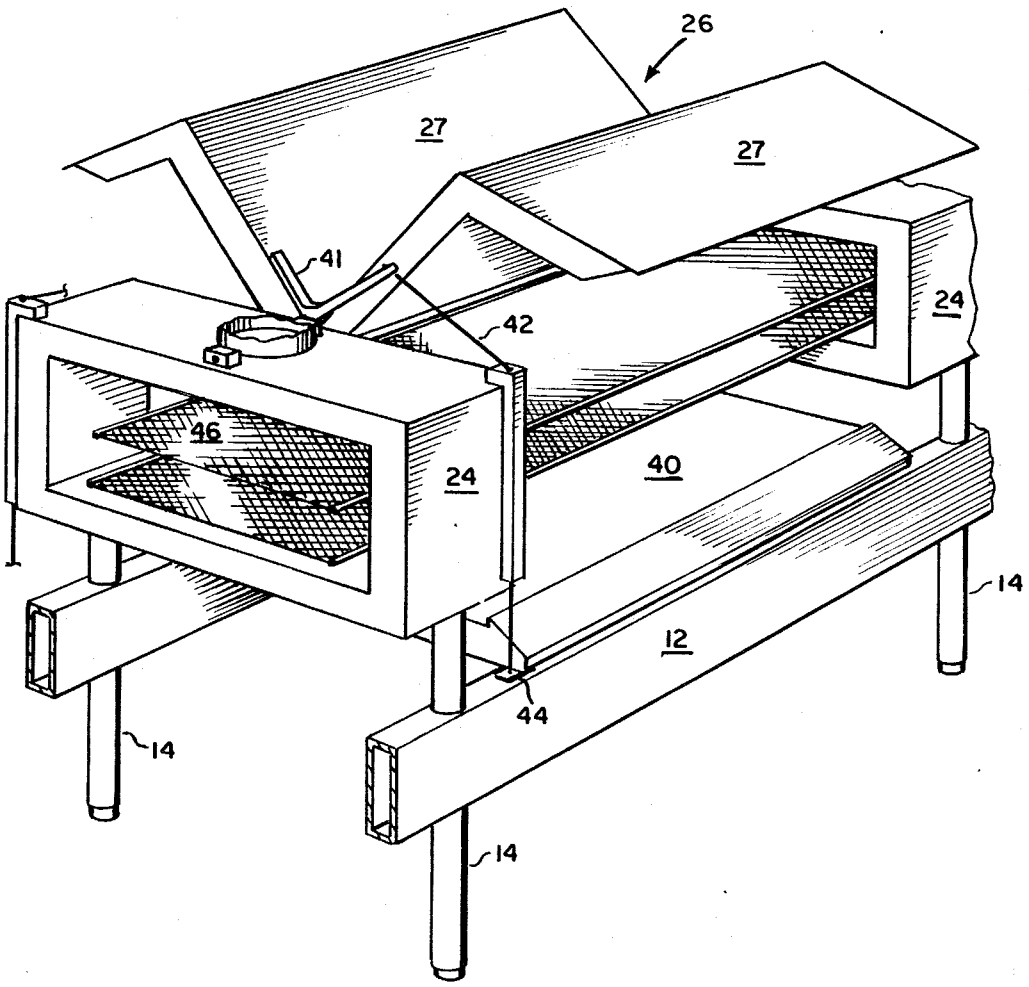
FIG. 5 is a fragmentary perspective view of a openable section of the tunnel and illustrates the hinged top covers pivoted open and the bottom portion lowered to completely expose the conveyor belt and the interior surfaces of the section, as well as the interior surfaces of the adjacent stationary sections. The cable linkage between the hinged cover and the bottom is also illustrated.

The precise simultaneous operation of the openable section of the tunnel 10 is shown in FIG. 5. Opposed hinged covers 27 are raised pivotably along an axis running longitudinally parallel to the longitudinal axis of the tunnel and supported on the stationary sections 24. Each cover 27 is elevated by an arm 41, pulled by cable 42, affixed to a finger 44 of the bottom 40 which descends during the opening movement. Although not shown in this perspective illustration, the nearside cover 27 has a similar arm 41 and cable linkage 42 connected to the bottom 40 at its opposite end which is hidden by the near side cover 27 itself. These cables 42 are threaded through the stationary tunnel sections 24 which are in turn affixed to the stationary tunnel support frame 12 and its support legs 14. The endless continuous conveyor belt 46 is illustrated with cross hatch in the interior of the tunnel and passes through both the stationary section 24 and the openable section 26 of the tunnel.

Although the details of operation of the tunnel 10 have been briefly described in demonstrating the improved actuation means, a more detailed description is provided in U.S. Pat. Nos. 3,813,895 and 3,892,104, hereby incorporated herein by reference. For instance, the tunnel generally has a plurality of overhead fans mounted on the stationary sections 24 to induce movement of cooling gas within the tunnel.

The description of the invention has been directed to a single tunnel. However, in practice the tunnel is frequently combined with additional tunnels of like or similar design to create an elongated freezing means for more time consuming freezing operations or more difficulty freezeable products. Thus a series of tunnels with their own lift and actuation means may be joined to operate from a common source of pressurized fluid and control means. Such plurality of tunnels may have common cryogenic cooling fluid and common conveyor means.

Alternately, the tunnels used in combination may have various combinations of independent or common cooling fluid, conveyors and actuation means.

The present invention has been set forth with regard to a preferred embodiment. However the scope of the invention should not be deemed to be limited to that embodiment, but rather should be ascertained from the claims which follows.

I claim:

1. In an apparatus for continuous cooling of articles comprising an elongated tunnel defined by a plurality of alternate openable and stationary sections, conveyor means in said tunnel for moving articles longitudinally therethrough, means for applying cooling fluid to articles moving through said tunnel, means for inducing movement of said cooling fluid through said tunnel in generally counterflow relation to the direction of movement of articles moving through said tunnel, means carried solely by said plurality of stationary sections for supporting said conveyor means within said tunnel, and means for opening said openable sections whereby complete access may be had to all of said sections of said tunnel without moving said conveyor means relative to said stationary sections, the improvement comprising actuation means including an assembly of toggle linkages connected through push rods to a pressurized fluid drive means for moving the openable sections of said apparatus to an open or closed position respective to said stationary sections.

2. The apparatus of claim 1 wherein the tunnel is supported along its length on a stationary tunnel support frame.

3. The apparatus of claim 2 wherein the openable sections comprise top, depending side wall portions defining hinged covers adapted to open upwardly and bottoms supported on a lift frame adapted to open downwardly.

4. The apparatus of claim 3 wherein the toggle linkages are pivotably connected to the tunnel support frame and the lift frame so as to raise the bottom to a closed position or lower the bottom to an open position upon actuation by the drive means through the push rods.

5. The apparatus of claim 4 wherein the hinged covers are opened and closed simultaneously with the bottoms by a cable linkage between the covers and bottoms.

6. The apparatus of claim 5 wherein the lift frame extends under and supports a plurality of said bottoms of the openable sections and is actuated by said toggle linkages whereby a plurality of said bottoms can be moved in unison by a set of toggle linkages.

7. The apparatus of claims 6 wherein the stationary and openable sections constitute insulated walls of the tunnel in their closed position.

8. The apparatus of claim 7 wherein the lift frame has an end guide at either longitudinal end thereof which cooperates slidingly with a bumper on the stationary tunnel support frame to retain the lift frame in longitudinal position when the actuation means is actuated.

9. The apparatus of claim 8 wherein the elongated tunnel has a pair of parallel pushrods and drives for moving the openable sections.

10. The apparatus of claim 9 wherein each pushrod has a plurality of toggle linkages.

11. The apparatus of claim 10 wherein each toggle linkage comprises a first link pivotably connected at its one end to the lift frame and pivotably connected at its other end to the pushrod and a second link pivotably connected at its one end to the stationary tunnel support frame and pivotably connected at its other end to said pushrod.

12. The apparatus of claim 11 wherein each link is positioned at an angle of approximately 73 degrees to the horizontal when the tunnel is in the closed position.

13. The apparatus of claim 12 wherein the lift frame is arranged to move approximately $8\frac{1}{2}''$ along a vertical axis between the open and closed positions.

14. The apparatus of claim 1 wherein the pressurized fluid drive means is a pneumatic drive means.

15. The apparatus of claim 1 wherein the pressurized fluid drive means is a hydraulic drive means.

16. The apparatus of claim 1 wherein a plurality of elongated tunnels are joined for cooperative cooling of articles.

* * * * *